US005124899A

United States Patent [19]

Hale

[11] Patent Number: 5,124,899

[45] Date of Patent: Jun. 23, 1992

[54] BASKETBALL GOAL LIGHT

[76] Inventor: Roger G. Hale, 5701 Sandshell, Fort Worth, Tex. 76137

[21] Appl. No.: 778,347

[22] Filed: Oct. 16, 1991

[51] Int. Cl.[5] ..... F21V 33/00

[52] U.S. Cl. ..... 362/253; 362/431; 273/1.5 R

[58] Field of Search ..... 362/234, 253, 431, 427; 273/1.5 R, 1.5 A

[56] References Cited

U.S. PATENT DOCUMENTS 4,459,649 7/1984 Shaneour ..... 362/431

4,984,787 1/1991 Nesbit et al. ..... 273/1.5 R

*Primary Examiner*—Stephen F. Husar

*Attorney, Agent, or Firm*—Geoffrey A. Mantooth

[57] ABSTRACT

A lighting apparatus for a basketball goal has a light and a support member. The support member, which supports and mounts the light is made up of plural conduit members joined together in an end to end fashion. The light is coupled to one end of the support member. The other end of the support member is coupled to the back side of the basketball goal. The support member is configured so as to extend up and over the basketball goal, wherein the light is located above and in front of the goal. The light illuminates the goal and the surrounding playing area from a visually remote location so that players do not look directly at the light.

6 Claims, 1 Drawing Sheet

BASKETBALL GOAL LIGHT

FIELD OF THE INVENTION

The present invention relates to lighting apparatuses in general and more particularly to lighting apparatuses for use in sporting activities.

BACKGROUND OF THE INVENTION

Due to the popularity of basketball, many homes and residences have basketball goals located outside on a driveway, patio or other playing surface. The basketball goal is typically located on a pole that is located in the ground next to the playing surface.

Basketball season occurs in the fall, winter and spring months, when the days are short. It is a frequent occurrence for a basketball game to be played at night. Lighting for the game is usually inadequate, involving a porch light or similar type of house light.

It is therefore an object of the present invention to provide a light for use on a basketball goal, which light would sufficiently illuminate the goal and the playing area around the goal.

It is a further object of the present invention to provide a light for use on a basketball goal, which light would not interfere with the player's vision.

DESCRIPTION OF PREFERRED EMBODIMENT

Figures 1, 2, 3:
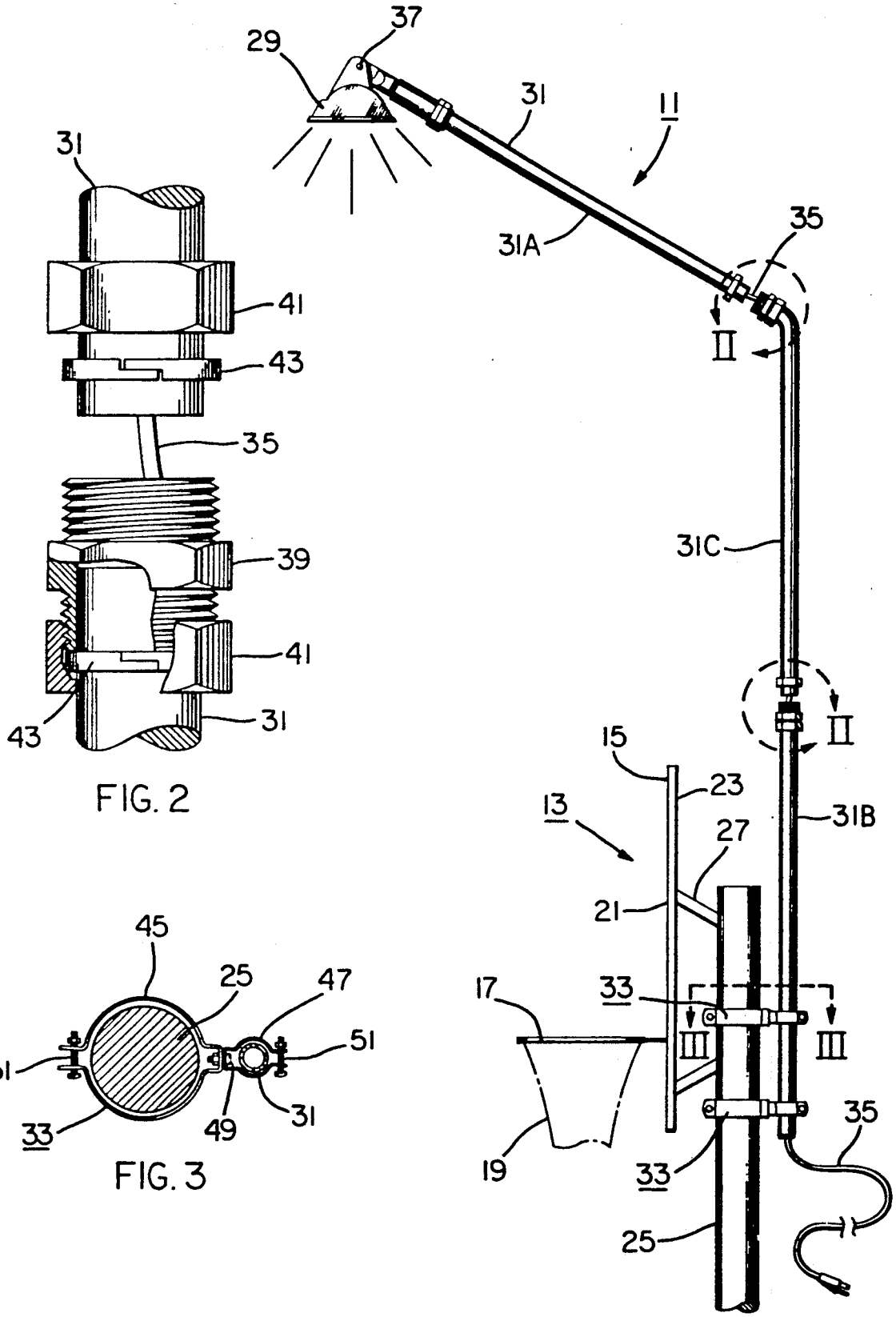
FIG. 1 shows a schematic side view of the top end of a basketball goal, onto which a lighting apparatus of the present invention, in accordance with a preferred embodiment, has been installed.
FIG. 2 shows a detail view of a joint of two conduit members in FIG. 1, taken at circles II.
FIG. 3 shows a cross-sectional view of FIG. 1, taken through lines III—III, and serves to illustrate a top view of one of the coupling devices used.

The lighting apparatus 11 of the present invention, in accordance with a preferred embodiment, is shown in FIG. 1. The lighting apparatus is mounted onto a conventional basketball goal 13. The lighting apparatus is inexpensive to build, simple to install and greatly improves the illumination of the goal in the playing area around the goal. The light shines on the front side of the goal for shooting and shines on the court surface below for dribbling and passing. Furthermore, the lighting apparatus locates the light high and away from the goal so that a player does not look directly into the light when playing. Thus, players are not bothered by being blinded by a bright light.

The basketball goal 13 includes a backboard 15, a rim 17 coupled to the backboard, and a net 19 hanging from the rim. The backboard 15 has front and back sides 21, 23. The back side 23 of the backboard is coupled to the upper end of a vertical pole 25 by way of struts 27. The lower end of the pole (not shown) is securely anchored in the ground. The rim 17 is located on the front side 21 of the goal and is typically located 10 feet off of the ground, although it may be set lower.

The basketball goal light 11 of the present invention includes a light 29, conduit members 31, coupling devices 33 and an electrical cord 35.

The light 29 is a conventional electric light. In the preferred embodiment, the light 29 is a high intensity incandescent lamp. The lamp is housed in a durable housing suitable for outside use. The back end of the housing is provided with a pivot joint 37 to allow pointing of the lamp in the desired direction.

There are provided three conduit members, namely an upper member 31A, a lower member 31B, and an intermediate member 31C. The upper and lower members 31A, 31B are straight lengths, while the intermediate member 31C has a bend near the upper end. Each conduit member 31 is a galvanized metal tube suitable for holding electrical wire. The conduit members are joined to each other at a respective joint. Each joint is formed by a threaded fitting 39, lock nuts 41 and lock rings 43. The threaded fitting 39 has an inside diameter that is slightly larger than the outside diameter of the conduit members 31 such that the threaded fitting slips onto the respective conduit members, as shown in FIG. 2. Each lock ring 43 is split to allow expansion and contraction of its diameter. To couple two conduit members together, one end of each conduit member is inserted into the threaded fitting 39. A lock ring 43 is placed onto the conduit member in abutting relation to each end of the threaded fitting 39. Then, the respective lock nut 41 is positioned to encompass the lock ring 43 and the lock nut is screwed onto the respective end of the threaded fitting 39. As the lock nut 41 is tightened onto the threaded fitting, the lock ring is compressed, thereby securing the threaded fitting onto the conduit members 31 and securing the conduit members together.

The conduit members 31 are all fitted together so as to form an extended support for the light. The light 29 is coupled, by way of a threaded fitting 39, to the upper end of the upper conduit member 31A. The electrical cord 35 extends from the light through the interior of the conduit members. The cord exits the conduit members at the lower end of the lower conduit member 31B. Thus, the cord 35 is exposed only when it exits the lower end of the conduit member. A rubber stopper can be inserted into the lower end of the conduit member to provide a seal around the cord 35. An extension cord may be used to reach a 120 volt receptacle.

In the preferred embodiment, the coupling devices 33 are ring clamps that couple the lower member to the basketball goal pole 25. Each coupling device has two ring clamps 45, 47 (see FIG. 3, where the clamps are shown in the loosened condition). One ring clamp 45 is sized to fit around the pole 25, and the other ring clamp 47 is sized to fit around the lower conduit member 31B. The two ring clamps are coupled together by a nut and bolt 49. Each clamp is provided with a nut and bolt 51 for opening and closing the respective clamp.

To install the lighting apparatus of the present invention, the two coupling devices 33 are first coupled to the upper end of the pole 25 by way of the clamps 45. The coupling devices are spaced apart from each other as shown in FIG. 1. Then, the lower coupling member 31B is inserted into the clamps 47 and secured therein.

When installed, the coupling members 31 support and position the light 29 relative to the pole 25. The light 29 is positioned above the goal and on the front side 29 of the backboard 15. In the preferred embodiment, the light 29 is located about 20 feet above the ground and about 4 to 5 feet in front of the backboard 15. The light illuminates the backboard and the surrounding playing area from an overhead position. This allows the players to see while dribbling, passing and shooting.

What is surprising is that the light 29 does not interfere with the vision of the players using the basketball goal. As the players look to the goal for a shot, they do not look directly into the light and are thus not blinded by the light. Instead, the light is located sufficiently remote from the goal so as to be visually indiscreet, while at the same time providing sufficient illumination to light up the backboard of the goal.

Although the lighting apparatus of the present invention has been described as being coupled to a basketball goal pole, it could also be coupled to the support structure of a roof-mounted goal. A roof-mounted goal does not use a pole, instead it is mounted onto the roof of a house or garage.

The foregoing disclosure and the showings made in the drawings are merely illustrative of the principles of this invention and are not to be interpreted in a limiting sense.

I claim:

1. A lighting apparatus for a basketball goal, said basketball goal having front and back sides, comprising:

a) a light;

b) an elongated support member having first and second ends, said light being coupled to said support member first end, said support member second end being coupled to said back side of said basketball goal;

c) said support member being configured so as to extend up and over said basketball goal so that said light is located above and in front of said goal.

2. The lighting apparatus of claim 1 wherein said support member comprises plural conduit members.

3. The lighting apparatus of claim 1 wherein said support member is coupled to said basketball goal by clamping means.

4. A lighting apparatus for a basketball goal, said basketball goal having front and back sides, said basketball goal having a pole for supporting said goal above ground, comprising:

a) a light;

b) plural conduit members for supporting and mounting said light, each of said conduit members having respective ends, said conduit members being coupled together in an end to end fashion so as to form a support member, said support member having first and second ends;

c) said light being coupled to said support member first end;

d) an electrical cord for providing electrical power to said light, said cord extending through said conduit members from said light to said support member second end;

e) coupling means for coupling said support member second end to said basketball goal pole, said coupling means being coupled to said support member;

f) said support member being configured so as to extend up and over said basketball goal so that said light is located above and in front of said goal, wherein said light illuminates said goal front side from a visually remote location so that players do not look directly into said light when playing.

5. The lighting apparatus of claim 4 wherein said support member is coupled to said basketball goal pole by clamping means.

6. The lighting apparatus of claim 4 wherein said light is pivotally coupled to said support member so as to allow the selective orientation of said light.

* * * * *